United States Patent [19]

Alberny et al.

[11] 4,042,008

[45] Aug. 16, 1977

[54] CONTINUOUS-CASTING MOLD WITH ELECTROMAGNET

[75] Inventors: Robert Alberny; Louis Vedda, both of Metz, France

[73] Assignee: Institut des Recherches de la Siderurgie Francaise, Saint-Germain-en-Laye, France

[21] Appl. No.: 723,194

[22] Filed: Sept. 14, 1976

[30] Foreign Application Priority Data

Sept. 17, 1975 France ..... 75.28439

[51] Int. Cl.[2] ..... B22D 11/02; B22D 27/02

[52] U.S. Cl. ..... 164/147; 219/10.79

[58] Field of Search ..... 164/49, 147; 335/300; 219/10.79; 13/27

[56] References Cited

U.S. PATENT DOCUMENTS

| | | | |
|---|---|---|---|
| 2,398,018 | 4/1946 | Linley et al. | 164/49 |
| 2,970,830 | 2/1961 | Siegfried | 164/49 X |
| 3,919,678 | 11/1975 | Penfold | 335/300 |
| 3,941,183 | 3/1976 | Vedda et al. | 164/147 |
| 4,009,749 | 3/1977 | Alberny | 164/147 |

*Primary Examiner*—Robert D. Baldwin
*Attorney, Agent, or Firm*—Michael J. Striker

[57] ABSTRACT

A continuous-casting mold has two long sides each of which is provided with a cooling box through which water is passed in order to cool the copper-alloy sides of the mold. Provided inside this cooling box is a plurality of inductors each wound around a magnetic element that extends between the box on one side and the wall of the mold on the other side so that these magnetic elements can act both as inductor cores and as support struts between these two facing walls. The magnetic elements may be formed as horizontal plates about which are wound elongated coils, or may be cylindrical pins on which cylindrical coils are wound.

10 Claims, 6 Drawing Figures

CONTINUOUS-CASTING MOLD WITH ELECTROMAGNET

CROSS-REFERENCE TO RELATED APPLICATION

This application is related to the copending and commonly assigned patent application Ser. No. 471,972 filed May 21, 1974, now U.S. Pat. No. 3,981,345 issued Sept. 21, 1976.

BACKGROUND OF THE INVENTION

The present invention relates to a mold for a continuous-casting process. More particularly this invention concerns such a mold provided with an electromagnetic mixer.

In the continuous casting of metal an upwardly and downwardly open tubular mold is used into which the liquid metal is poured. The walls or sides of the mold are cooled so that the metal solidifies in this mold at least in an outer skin before it withdraws from the lower end of the mold. The interior of the workpiece in the mold at least is still liquid and forms a so-called crater. The sides of the mold are normally made of highly conductive material such as copper in order to maximize heat exchange between the casting being continuously formed and the mold which itself is normally cooled by means of water.

The main problem in continuous-casting operations is that due to thermal contraction the skin of the casting separates from the mold so that the rate of heat extraction from the casting is relatively low. Furthermore, the casting produced by this method often is inadequately homogeneous so that it cannot be used for the production of many types of metals, in particular steel.

It has been found possible to partly solve some of these problems by providing on at least one of the sides of the mold a heavy-duty inductor whose magnetic field passes through the casting and produces eddy currents that serve to mix the molten metal in the casting, thereby increasing homogeneity of the casting so produced and also augmenting heat exchange. Thus it is possible to produce a high-quality bloom, slab, or billet even with steels that have hitherto often been considered unsuitable for continuous casting.

A principal difficulty with such arrangements is that the mold is not sufficiently rigid. Thus, the casting produced by the mold is often relatively irregular so that its subsequent rolling becomes rather difficult. The provision of coils in the cooling box adjacent the long sides of the mold further greatly reduces the rigidity of most mold structures so that it is necessary to make a tradeoff between supporting structure and inductive capacity. For this reason the coil is often inadequately small in order to allow various braces to be mounted inside the cooling box. In particular when the ferrostatic pressure of casting and the hydraulic pressure of the coolant is relatively high it is necessary to provide so very many supporting structures inside the cooling box that only very small inductors can be fitted in. A solution to this has been attempted by increasing the depth of the cooling chamber. Thus, the number of ampere-turns is increased, but nonetheless it becomes very difficult to rigidify the cool side of the mold across such a deep cooling box. This also makes the installation relatively bulky and quite heavy.

SUMMARY OF THE INVENTION

It is therefore an object of the present invention to provide an improved continuous-casting mold.

Another object is the provision of such a mold using electromagnetic mixing.

A further object is to provide an improved continuous-casting mold which is extremely rigid and which has a large-capacity inductor.

These objects are attained according to the present invention in a mold of the above-described general type wherein a plurality of rigid metallic elements are provided in the cooling box attached to the long side of the tube forming the mold. These elements are braced between the one side of the mold and the opposite wall of the box so as to form a rigidifying connection therebetween. A coil is wound on each of these elements so that these elements also serve as the cores of the coils. Such double use of the rigidifying struts therefore allows a very compact mold to be formed which overcomes the above-given disadvantages.

According to further features of this invention the metallic elements forming the coil cores extend horizontally and perpendicular to the respective side of the tube. This side of the tube is formed, as mentioned above, of copper or a copper alloy and no magnetic material is interposed between these elements and the side of the mold. At their other ends these core elements are in contact with a magnetic, preferably ferromagnetic, plate which closes the outside of the magnetic circuit and which is clamped to the core elements by means of bolts serving as struts passing through the core elements. These bolts are anchored at one end in the nonmagnetic side of the mold and at their other ends are in the ferromagnetic plate.

According to yet another feature of the present invention the core elements are each formed as a flat plate having a flared end extending toward and engaging the side of the mold. Each of these plates is symmetrical about a horizontal plane and extends generally horizontally. The coils are wound around them so that these coils are of parallopipedal shape.

It is also possible in accordance with this invention to form each of the poles as a generally cylindrical pin, once again having a flared end extending toward and engaging the side of the mold. Cylindrical coils are wound around each of these pins.

There is provided between each of the coils and its respective core element and between adjacent coils a plurality of spacers which allow the coolant circulating through the chamber formed by the cooling box to pass between these various parts and cool them. Furthermore in accordance with this invention a nonmagnetic plate may lie against the side of the mold and be formed with throughgoing holes in which are fitted the flared ends of these core elements. This nonmagnetic plate may have holes at its top and/or bottom that communicate with vertical slots in the mold side so that liquid can flow up through this mold side and act as the coolant.

With the system according to this invention it is therefore possible to provide an extremely powerful magnet inside the cooling box, while at the same time allowing a great deal of support to suitably rigidify the side of the mold. Such a structure has been found to facilitate the continuous casting of many types of steel which have hitherto not been castable in a continuous process. In particular, the excellent mixing obtained allows impurities to rise to the surface and often eliminates the necessity for flames scorching the blooms, slabs, or billets produced by this method.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

SPECIFIC DESCRIPTION OF PREFERRED EMBODIMENTS

Figure 1:
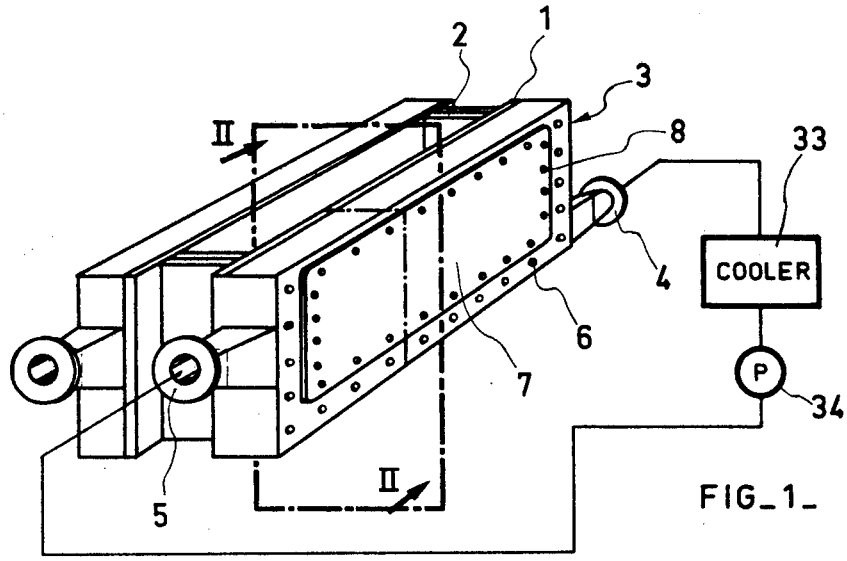
FIG. 1 is a perspective view of a mold according to this invention.

As shown in FIGS. 1–4 a mold according to this invention has a pair of relatively long side walls 1 and relatively short end walls 2 that form an upwardly and downwardly open tube suitable for the continuous casting of steel such as described on pages 664–666 of *The Making, Shaping, and Treating of Steel* (U.S. Steel: 1964). Each of the walls 1 is provided with a parallepipedal cooling box 3 having at the bottom of its one end an inlet 4 and at the middle of its other end an outlet 5 so that water can be circulated through the box 3 and a cooler 33 by means of a pump 34. The walls 1 and 2 are made of a highly conductive but nonmagnetic copper alloy so that molten steel can be poured into the top of the tube formed by these walls 1 and 2.

Figure 2:
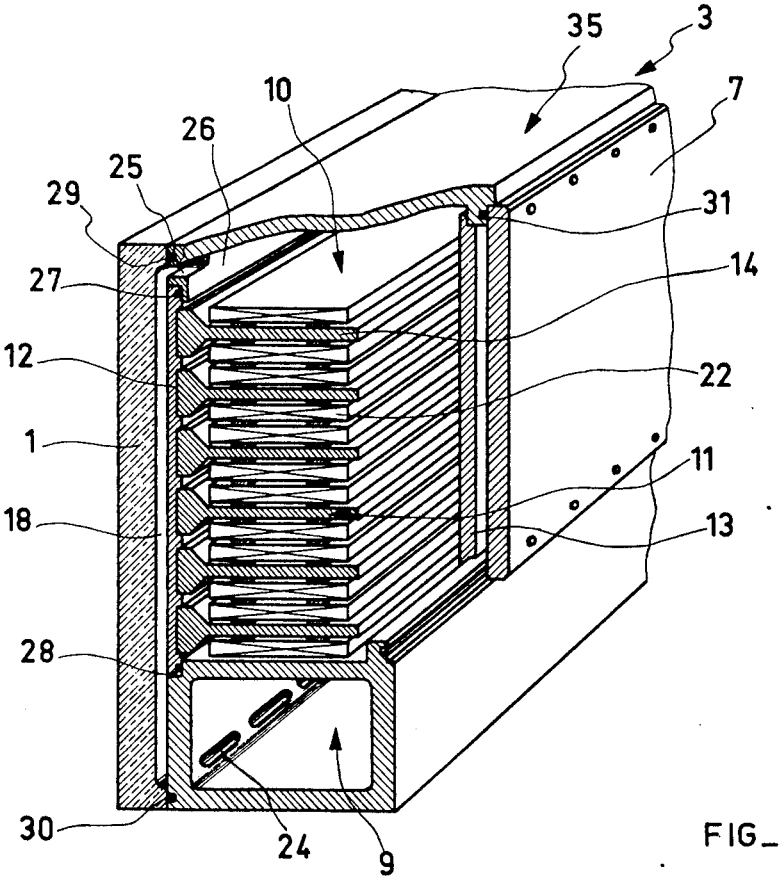
FIG. 2 is a section taken along line II—II of FIG. 1.
Figure 3:
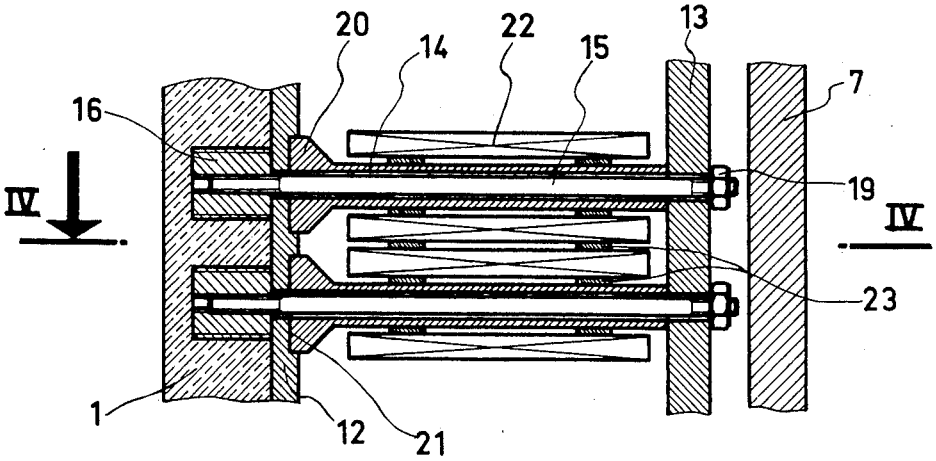
FIG. 3 is a large-scale vertical section through a detail of FIG. 2.

A plurality of struts or bolts 6 secure the box 3 to the respective side wall 1 and a removable cover plate 7 giving access to the electromagnet is held thereagainst by means of bolts 8 around its periphery. The interior of the box 3, as best shown in FIG. 2, is subdivided into an inlet compartment 9 and an outlet compartment 10 containing the inductors 11. The inlet compartment 9 is formed as a square-section steel tube secured as mentioned above by bolts 6 to the wall 1 and formed along its lower edge with a plurality of laterally throughgoing slots 24. The wall 1 is formed with a plurality of vertical grooves 18 also shown in FIG. 4 which allow the water introduced via the inlet pipe 4 to flow upwardly along this wall 1 and cool it. At their top ends these slots 18 communicate via horizontal slots 25 in a lip 26 of an upper plate 35 with the compartment 10 at the upper region thereof. The outlet compartment 10 is defined between a nonmagnetic plate 12 overlying the wall 1 at the slots 18 and a ferromagnetic plate 13. The plate 12 is formed with a plurality, here 6, of slots 21 in which are seated flared ends 20 of ferromagnetic core elements 14 on which are mounted coils 22 via insulating spacers 23, similar spacers are provided between adjacent coils.

Further struts or tiebolts 15 are provided which extend through these elements 14 and are threaded at one end into plugs 16 of nonmagnetic material threaded into the wall 1 and at their other ends are provided with nuts 19 that clamp the elements 14 between the plates 12 and 13. Seals 27 and 28 are provided between the plate 12 and the compartment 9 and lip 26 of the upper plate 35. Another seal 29 is provided between the wall 1 and the upper plate 35 of the box 3 whereas the seal 31 is provided between this plate 35 and the cover plate 7. The elements 13 and 14 are made of ferromagnetic steel or iron. On the contrary the elements 12, 15 and 16 are made of nonmagnetic steel, preferably of the stainless type.

Figure 4:
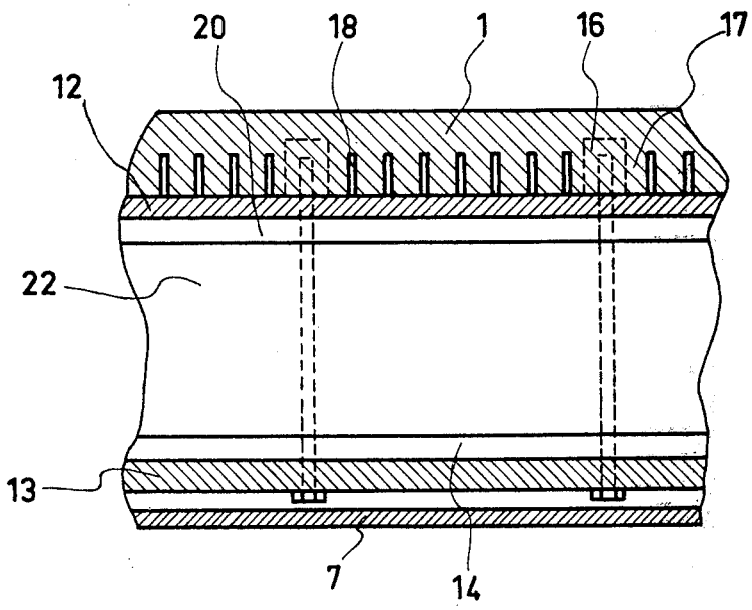
FIG. 4 is a section taken along line IV—IV of FIG. 3.

The plates 14 are symmetrical about horizontal planes and may be formed as stacks of soft-iron sheets. The plugs 16 in which the ends of the bolts 15 are mounted are received in ridges or lands 17 formed between the vertical grooves 18 as best shown in FIG. 4. This construction insures that the entire assembly is extremely rigid, the walls and the inductors well cooled and the molten steel inside the mold efficiently stirred.

When a stack of sheets is used to form the elements 14 the sheets of the stack will lie in plane parallel to the lines of force.

The plate 13 may similarly be made of a stack of such soft-iron sheets.

Figure 5:
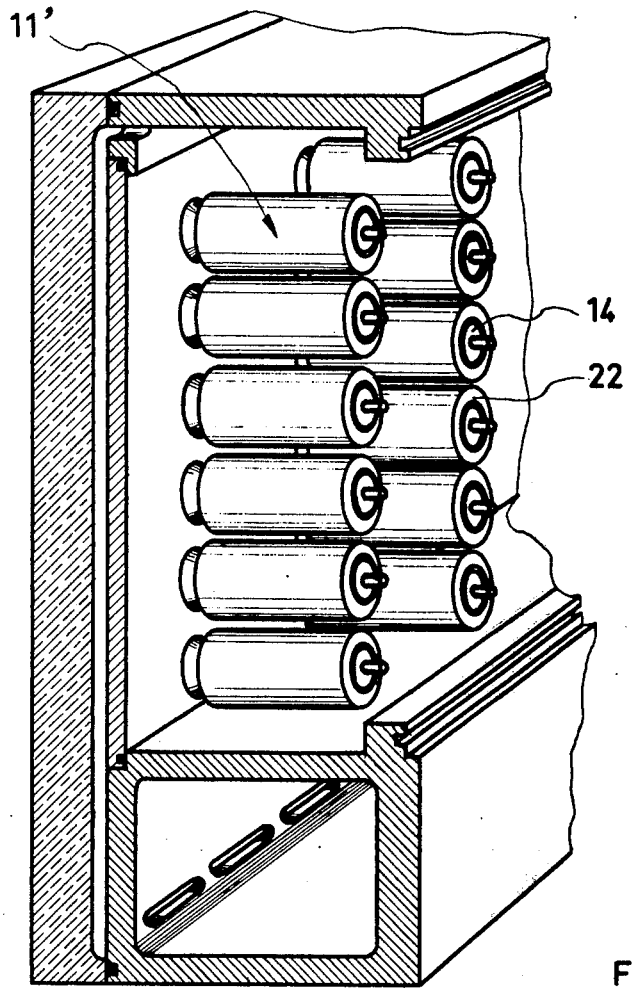
FIGS. 5 and 6 are views corresponding to FIGS. 2 and 3 showing another arrangement in accordance with this invention.
Figure 6:
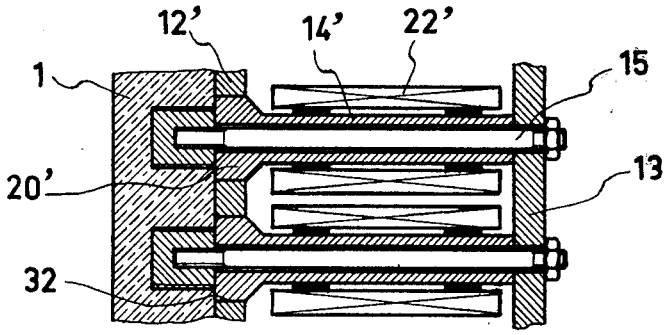

The arrangement of FIGS. 5 and 6 is identical to that of FIGS. 1–4 except that here cylindrical pins 14' replace the flat plates 14 and have cylindrical flared ends 20' received in correspondingly shaped throughgoing cylindrical holes 32 in the plate 12'. Cylindrically tubular coils 22' surround these pins 14' and therefore form a mass of inductors 11' identical in function to the inductors 11 of FIGS. 1–4.

It will be understood that each of the elements described above, or two or more together, may also find a useful application in other types of structures differing from the types described above.

While the invention has been illustrated and described as embodied in a continuous-casting mold, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mold for continuous casting, said mold comprising: a tube having a plurality of sides of non-magnetic material; a box defining a cooling chamber connected to one of said sides and having a wall parallel to said one side and an inlet and an outlet, whereby fluid can be passed through said chamber from said inlet to said outlet to cool said one side and said wall; means including a plurality of rigid metallic elements in said box braced between said one side and said wall for forming a rigid connection therebetween; and a coil wound on each of said elements, whereby electrical energization of said coils forms a magnetic field extending through said one side and said wall into said tube.

2. The mold defined in claim 1 wherein said tube is upright and rectangular and has a pair of long sides and a pair of short sides, each such long side being provided with one such box having in turn a plurality of such elements and such coils.

3. The mold defined in claim 2 wherein said boxes are each partitioned into an inlet compartment having said inlet and an outlet compartment containing said elements and coils and having said outlet.

4. The mold defined in claim 1 wherein said elements are magnetic and extend generally horizontally and normally to said one side.

5. The mold defined in claim 4 wherein said wall of said box is magnetic, said mold further comprising connecting members each passing through a respective element and each anchored in said wall and in said one side.

6. The mold defined in claim 1 wherein each of said elements is a flat horizontal plate and said mold further comprises spacers between said coils and said plates and between adjacent coils, whereby spaces between said coils and said plates permit coolant to flow therebetween.

7. The mold defined in claim 6 wherein each of said plates has a flared edge engaging said one side and each plate is symmetrical about a horizontal plane, said mold further comprising a nonmagnetic cover plate on said one side facing said wall and formed with throughgoing slots each receiving a respective one of said flared edges.

8. The mold defined in claim 4 wherein each of said elements is a cylindrical pin and each of said coils is wound cylindrically around the respective pin.

9. The mold defined in claim 8, further comprising a nonmagnetic cover plate on said one side facing said wall, and formed with a plurality of throughgoing holes, said pins each having a flared end engaging said one wall and extending through a respective one of said holes.

10. The mold defined in claim 4 wherein each of said elements is a stack of ferromagnetic sheets each extending in the direction of the lines of force of the inductor formed by the respective coil.

* * * * *